US005084375A

United States Patent [19]

Umemoto et al.

[11] Patent Number: 5,084,375

[45] Date of Patent: Jan. 28, 1992

[54] COLOR PHOTOGRAPHIC LIGHT-SENSITIVE MATERIAL

[75] Inventors: Makoto Umemoto; Kozo Aoki, both of Kanagawa, Japan

[73] Assignee: Fuji Photo Film Co., Ltd., Kanagawa, Japan

[21] Appl. No.: 918,659

[22] Filed: Oct. 15, 1986

Related U.S. Application Data

[63] Continuation-in-part of Ser. No. 737,969, May 28, 1985, abandoned.

[30] Foreign Application Priority Data

May 26, 1984 [JP] Japan ..... 59-107128

[51] Int. Cl.[5] ..... G03C 7/34; G03C 1/815; G03C 1/34

[52] U.S. Cl. ..... 430/505; 430/507; 430/512; 430/549; 430/551; 430/552; 430/553; 430/556; 430/557

[58] Field of Search ..... 430/549, 552, 553, 505, 430/558, 512, 551, 554, 555, 556, 557, 507

[56] References Cited

U.S. PATENT DOCUMENTS

| | | | |
|---|---|---|---|
| 3,772,002 | 11/1973 | Ramello | 430/553 |
| 4,009,038 | 2/1977 | Arai et al. . | |
| 4,374,922 | 2/1983 | Ohbayashi et al. . | |
| 4,427,767 | 1/1984 | Aoki et al. | 430/549 |
| 4,513,082 | 4/1985 | Furutachi et al. . | |
| 4,526,864 | 7/1985 | Takada et al. | 430/553 |
| 4,537,857 | 8/1985 | Takada et al. | 430/553 |
| 4,552,836 | 11/1985 | Tanabe et al. | 430/553 |
| 4,613,565 | 9/1986 | Takada et al. | 430/553 |
| 4,666,826 | 5/1987 | Takada et al. | 430/549 |
| 4,686,177 | 8/1987 | Aoki et al. | 430/552 |
| 4,820,614 | 4/1989 | Takada et al. | 430/551 |

FOREIGN PATENT DOCUMENTS

| | | |
|---|---|---|
| 0112514 | 7/1984 | European Pat. Off. . |
| 0119860 | 9/1984 | European Pat. Off. . |
| 0159912 | 10/1985 | European Pat. Off. . |
| 3127279 | 6/1982 | Fed. Rep. of Germany . |
| 2272418 | 11/1975 | France . |

OTHER PUBLICATIONS

RD 17643; Photographic Silver Halide Emulsions, Preparations, Addenda, Processing and Systems; Dec. 1978.

Patent Abstracts of Japan, vol. 4, No. 107(P-21) [589], published Jul. 31, 1980 and concerning Japanese patent 55-65953.

Patent Abstracts of Japan, vol. 9, No. 62 (T-342) [785], Mar. 19, 1985, Tanabe et al.

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A color photographic light-sensitive material comprising a support having provided thereon a silver halide emulsion layer containing at least one each of cyan color image forming couplers represented by the following general formulae (I) and (II):

(I)

(II)

and at least one compound represented by the formulae (III) or (IV):

(III)

(IV)

wherein all the symbols are defined in the specification.

12 Claims, No Drawings

COLOR PHOTOGRAPHIC LIGHT-SENSITIVE MATERIAL

This is a continuation-in-part of application Ser. No. 737,969, filed May 28, 1985, abandoned.

FIELD OF THE INVENTION

This invention relates to a color photographic light-sensitive material having excellent preservability and, more particularly, to a silver halide color photographic light-sensitive material which forms a color image undergoing reduced fading on exposure to light or heat and scarcely losing color balance even after storing for a long period of time.

BACKGROUND OF THE INVENTION

In forming color photographic images, exposed light-sensitive materials having yellow, magenta and cyan photographic couplers in blue-sensitive, green-sensitive and red-sensitive light-sensitive layers, respectively, are subjected to color development processing using a color developing agent. In development processing, an oxidation product of an aromatic primary amine reacts with each of the above described couplers (coupling reaction) to give color dyes.

It is fundamentally important for the color dyes formed to be bright cyan, magenta and yellow dyes with minimal side absorptions, in order to provide color photographic images having well reproduced colors.

On the other hand, preservability of the color photographic image is also extremely important, and the color photographic images formed should have good preservability under various conditions.

In order to improve preservability, it is necessary not only to delay fading or color changing rates of color dyes of different hues, but that the fading rates of each color forming the image be as uniform as possible, to preserve the color balance of the remaining dye image.

However, conventional light-sensitive materials, particularly color papers, suffer serious deterioration of the cyan dye image after long time dark fading due to the influence of humidity and heat, thus exhibiting a change in color balance and, therefore, require improvement. On the other hand, conventional color dyes scarcely fading in the dark have the contrary disadvantages of poor color hues and cyan dye images which fade or disappear on exposure to light. For these reasons, it is desired to develop color photographic light-sensitive materials overcoming these problems.

Specific combinations of couplers have been proposed to partly solve these problems, as disclosed in, for example, Japanese Patent Publication No. 7344/77, Japanese Patent Application (OPI) Nos. 200037/82 and 57238/84 (the term "OPI" as used herein refers to a "published unexamined Japanese patent application open to public inspection"), and Japanese Patent Application No. 35178/83. However, these combinations provide only insufficient color forming properties or provide dyes of poor hue, thus being unsatisfactory for color reproduction. Particularly, the color balance of residual dye images produced by conventional coupler combinations changes as a result of deterioration on exposure to light or heat. Therefore, improvement of the combination is desired.

SUMMARY OF THE INVENTION

The present invention provides a color photographic light-sensitive material which overcomes the defects of conventional color photographic light-sensitive materials described above.

An object of the present invention is to provide a silver halide color photographic light-sensitive material which contains a combination of specific cyan color image forming couplers in a silver halide emulsion layer, and which, owing to the above described combination, possesses good color forming properties, gives a color photographic image with good color reproducibility and improved image preservability and, particularly, undergoes no significant change in color balance for a long period of time both on exposure to light and in the dark.

Another object of the present invention is to provide a silver halide color photographic light-sensitive material which provides an image with good preservability that does not lose color balance, not only in highly colored areas but also in gradation areas when stored for a long time under conditions of high temperature or high humidity, or both.

A further object of the present invention is to provide a silver halide color photographic light-sensitive material which has improved preservability and improved light fastness.

These and other objects of the present invention are attained by a color photographic light-sensitive material which comprises a support having provided thereon a silver halide emulsion layer containing at least one each of the cyan color image forming couplers represented by the following general formulae (I) and (II):

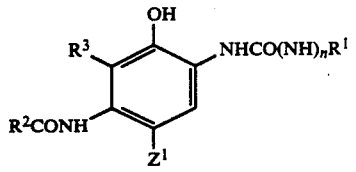

(I)

and

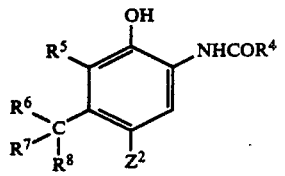

(II)

wherein:

$R^1$, $R^2$ and $R^4$ each represents an aliphatic hydrocarbon group, a substituted aliphatic hydrocarbon up, an aryl group, a substituted aryl group, a heterocyclic group or a substituted heterocyclic group;

$R^3$ and $R^5$ each represents a hydrogen atom, a halogen atom, an alkyl group or an acylamino group, or $R^3$ may represent a non-metallic atomic group necessary to form a nitrogen-containing 5- or 6-membered ring together with $R^2$;

$R^6$ represents an alkyl group having 1 to 14 carbon atoms;

$R^7$ and $R^8$, which may be the same or different, each represents a hydrogen atom;

$Z^1$ and $Z^2$ each represents a hydrogen atom or a group (including an atom; hereinafter the same) capable of being eliminated by a coupling reaction with an oxidation product of a developing agent (i.e., a coupling-off group); and n represents 0 or 1; and further containing at least one of the compounds represented by the following general formulae (III) and (IV) (ultraviolet light absorbing agents and antioxidants, respectively) further improves preservability of color images formed, particularly cyan color images:

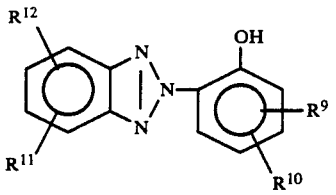

(III)

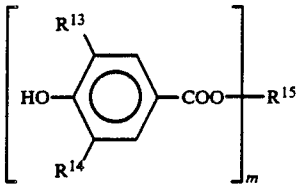

(IV)

wherein:

$R^9$, $R^{10}$, $R^{11}$ and $R^{12}$, which may be the same or different, each represents a hydrogen atom, a halogen atom, a nitro group, a cyano group, an optionally substituted alkyl group, an alkoxy group, an aryl group, an aryloxy group, an acylamino group or an alkoxycarbonyl group;

$R^{13}$ and $R^{14}$, which may be the same or different, each represents a hydrogen atom or an optionally substituted alkyl group, provided that they do not both represent a hydrogen atom; and $R^{15}$ represents an m-valent organic group with m being an integer of 1 to 4.

DETAILED DESCRIPTION OF THE INVENTION

One compound represented by the formula (III) which is commercially available in Tinuvin (which is a trade name of Ciba-Geigy).

As used herein, the term "aliphatic hydrocarbon group" means any of a straight chain, branched chain hydrocarbon or cycloaliphatic hydrocarbon group, and includes saturated groups (e.g., alkyl) and unsaturated groups (e.g., alkenyl or alkynyl).

Cyan couplers represented by the foregoing general formula (I) or (II) used in the present invention are described in more detail below.

In general formulae (I) and (II), $R^1$, $R^2$ and $R^4$ each represents an aliphatic hydrocarbon group containing 1 to 31 carbon atoms (e.g., a methyl group, a butyl group, an octyl group, a tridecyl group, an isohexadecyl group or a cyclohexyl group), an aryl group or a heterocyclic group (e.g., a phenyl group, a naphthyl group, a 2-pyridyl group, a 2-thiazolyl group, a 2-imidazolyl group, a 2-furyl group or a 6-quinolyl group), all of which may optionally be substituted with a group or groups selected from an alkyl group, an aryl group, a heterocyclic group, an alkoxy group (e.g., a methoxy group, a 2-methoxyethoxy group or a tetradecyloxy group), an aryloxy group (e.g., a 2,4-di-tert-amylphenoxy group, a 2-chlorophenoxy group, a 4-cyanophenoxy group or a 4-butanesulfonamidophenoxy group), an acyl group (e.g., an acetyl group or a benzoyl group), an ester group (e.g., an ethoxycarbonyl group, a 2,4-di-tert-amylphenoxycarbonyl group, an acetoxy group, a benzoyloxy group, a butoxysulfonyl group or a toluenesulfonyloxy group), an amido group (e.g., an acetylamino group, a butanesulfonamido group, a dodecylbenzenesulfonamido group or a dipropylsulfamoylamino group), a carbamoyl group (e.g., a dimethylcarbamoyl group or an ethylcarbamoyl group), a sulfamoyl group (e.g., a butylsulfamoyl group), an imido group (e.g., a succinimido group or a hydantoinyl group), a ureido group (e.g., a phenylureido group or a dimethylureido group), a sulfonyl group (e.g., a methanesulfonyl group, a carboxymethanesulfonyl group or a phenylsulfonyl group), an aliphatic or aromatic thio group (e.g., a butylthio group or a phenylthio group), a hydroxyl group, a cyano group, a carboxyl group, a nitro group, a sulfo group and a halogen atom. When $R^1$, $R^2$ or $R^4$ has two or more of these substituents, the substituents may be the same or different.

In general formula (I), $R^3$ represents a hydrogen atom, a halogen atom (e.g., a chlorine atom or a bromine atom), an alkyl group containing 1 to 4 carbon atoms (e.g., a methyl group, an ethyl group or a butyl group), an aryl group (e.g., a phenyl group, a naphthyl group), an acylamino group (e.g., an acetylamino group) or, when $R^3$ forms a ring together with $R^2$, $R^3$ represents non-metallic atoms forming a nitrogen-containing 5- or 6-membered ring. Typical examples of the moieties bridging between 5- and 6-positions of phenol ring as a result of the ring closure between $R^2$ and $R^3$ groups include $$-\underset{\underset{O}{\|}}{NHCCH_2CH_2}-,\quad -\underset{\underset{O}{\|}}{NHCCH_2}-,\quad -\underset{\underset{O}{\|}}{NHCNH}-,$$

$$-\underset{\underset{O}{\|}}{NHCNHCH_2}- \text{ and } -NH-\underset{\underset{O}{\|}}{C}-\underset{\underset{O}{\|}}{C}-NH-,$$

wherein the nitrogen atom of these groups bonds to the 5-position of the phenol ring and wherein the hydrogen atoms of these groups may be substituted with a lower alkyl group.

$R^5$ in general formula (II) represents a hydrogen atom, a halogen atom, an alkyl group containing preferably 1 to 4 carbon atoms, an aryl group (e.g., a phenyl group) or an acylamino group (e.g., an acetylamino group).

$Z^1$ in general formula (I) and $Z^2$ in general formula (II) each represents a hydrogen atom or a coupling-off group, for example, a halogen atom (e.g., a fluorine atom, a chlorine atom or a bromine atom), an alkoxy group (e.g., an ethoxy group, a dodecyloxy group, a methoxyethylcarbamoylmethoxy group, a carboxypropyloxy group or a methylsulfonylethoxy group), an aryloxy group (e.g., a 4-chlorophenoxy group, a 4-methoxyphenoxy group or a 4-carboxyphenoxy group), an acyloxy group (e.g., an acetoxy group, a tetradecanoyloxy group or a benzoyloxy group), a sulfonyloxy group (e.g., a methanesulfonyloxy group or a toluenesulfonyloxy group), an amido group (e.g., a dichloroacetylamino group, a heptafluorobutyrylamino group, a methanesulfonylamino group or a toluenesulfonylamino group), an alkoxycarbonyloxy group (e.g., an ethoxycarbonyloxy group or a benzyloxycarbonyloxy group), an aryloxycarbonyloxy group (e.g., a phenoxycarbonyloxy group), an aliphatic or aromatic thio group (e.g., an ethylthio group, a phenylthio group or a tetrazolylthio group), an imido group (e.g., a succinimido group or a hydantoinyl group) or an aromatic azo group (e.g., a phenylazo group). These coupling-off groups may contain a photographically useful group or groups.

Preferred examples of the cyan couplers represented by general formula (I) or (II) are as follows.

In general formula (I), $R^1$ preferably represents an aryl group or a heterocyclic group and, more preferably, an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, a hydroxycarbonyl group or a cyano group.

In general formula (I), where $R^3$ and $R^2$ are not connected to each other to form a ring, $R^2$ preferably represents a substituted or unsubstituted alkyl or aryl group, particularly preferably an alkyl group substituted with an aryloxy group which may further be substituted, and $R^3$ preferably represents a hydrogen atom.

$R^4$ in general formula (III) preferably represents a substituted or unsubstituted alkyl group or aryl group, particularly preferably an alkyl group substituted with an aryloxy group which may further be substituted.

$R^6$ in general formula (II) preferably represents an alkyl group containing 1 to 4 carbon atoms. The alkyl group represented by $R^6$ may be substituted with any conventional substituent for alkyl groups, such as an alkoxy group, an aryloxy group, an amino group, an acylamino group, a halogen atom, a nitro group, a hydroxyl group, a carboxyl group or a sulfo group. Preferred examples of $R^6$ include a methyl group, an ethyl group, a propyl group and a butyl group.

$R^5$ in general formula (II) preferably represents a hydrogen atom or a halogen atom, with a chlorine atom and a fluorine atom being particularly preferred.

Couplers represented by general formulae (II) wherein $R^6$ represents an alkyl group containing 1 to 4 carbon atoms, and $R^7$ and $R^8$ both represent a hydrogen atom are particularly preferred. In the above case, $R^5$ preferably represents a chlorine atom.

In general formulae (I) and (II), $Z^1$ and $Z^2$ preferably each represents a hydrogen atom, a halogen atom, an optionally substituted alkoxy group, an aryloxy group or a sulfonamido group.

$Z^2$ in general formula (II) preferably represents a halogen atom, with a chlorine atom or a fluorine atom being particularly preferred.

When n in general formula (I) represents 0, $Z^1$ more preferably represents a halogen atom, particularly preferably a chlorine atom or a fluorine atom.

Specific examples of the cyan couplers represented by the foregoing general formulae (I) and (II) are illustrated below, which, however, should not be construed as limiting the scope of the present invention in any way.

(I-1)

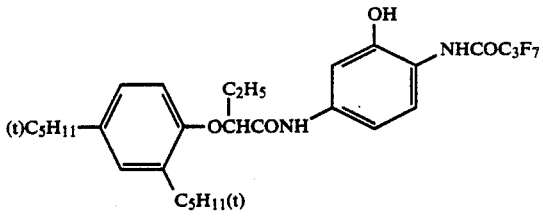

(I-2)

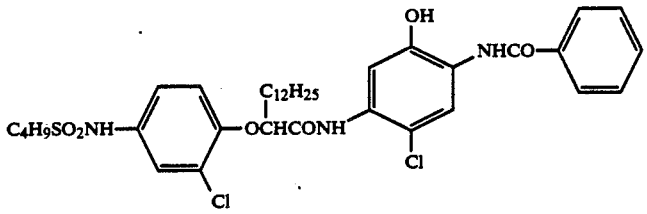

(I-3)

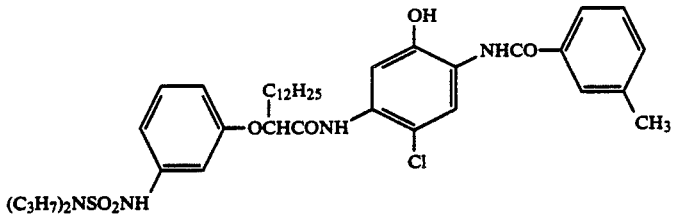

(I-4)

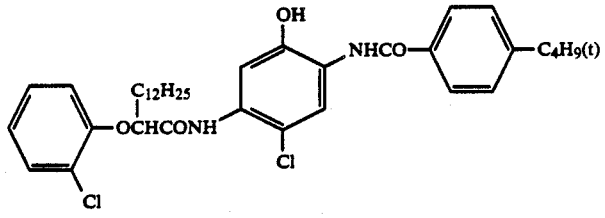

-continued
(I-5)
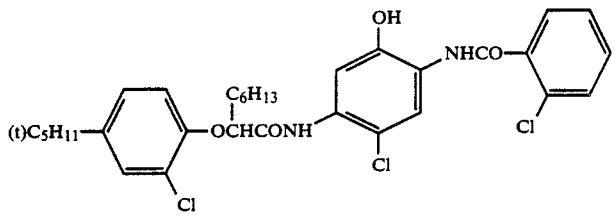
(I-6)
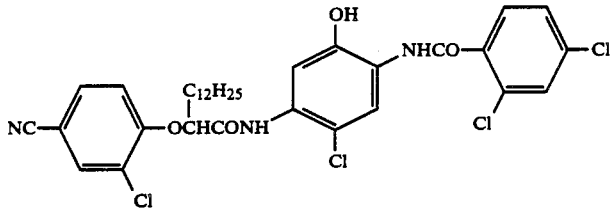
(I-7)
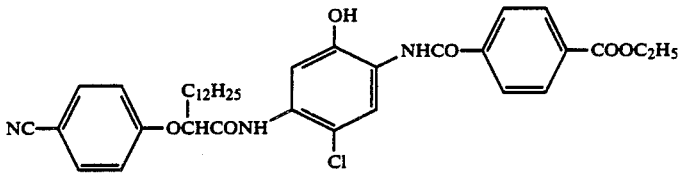
(I-8)
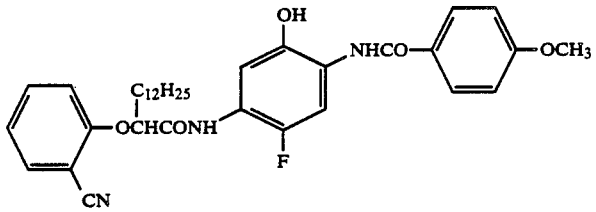
(I-9)
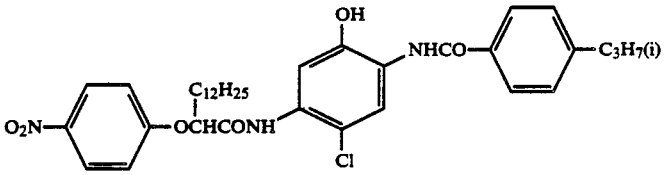
(I-10)
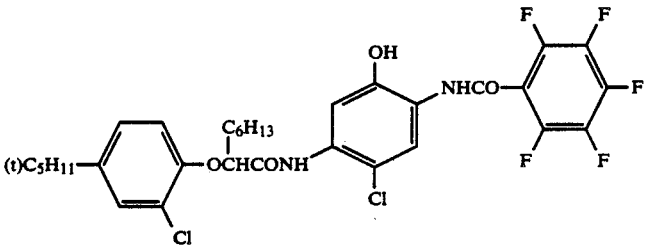
(I-11)
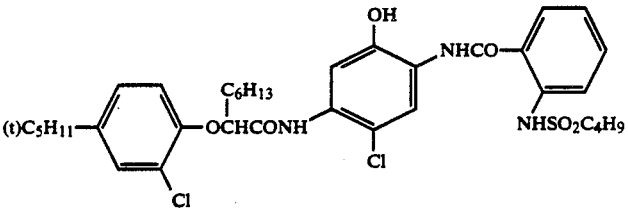

-continued
(I-12)
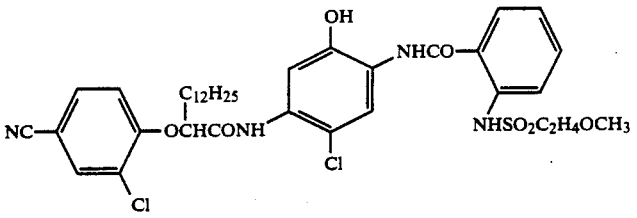
(I-13)
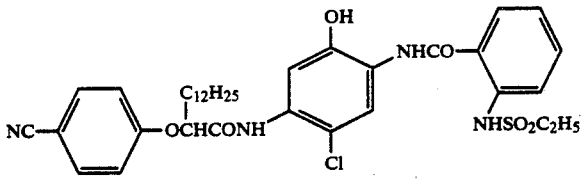
(I-14)
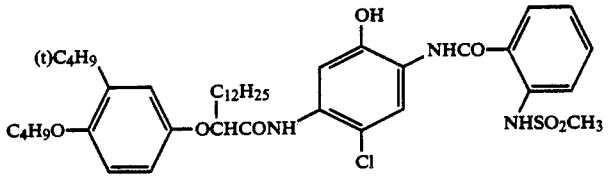
(I-15)
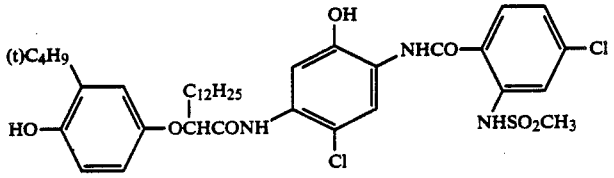
(I-16)
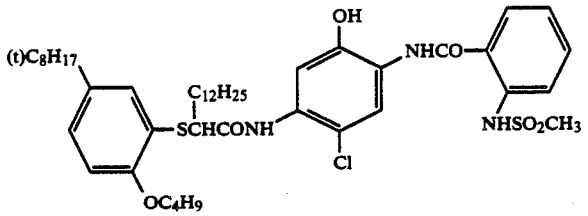
(I-17)
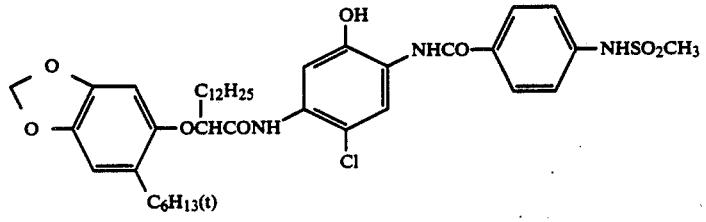
(I-18)
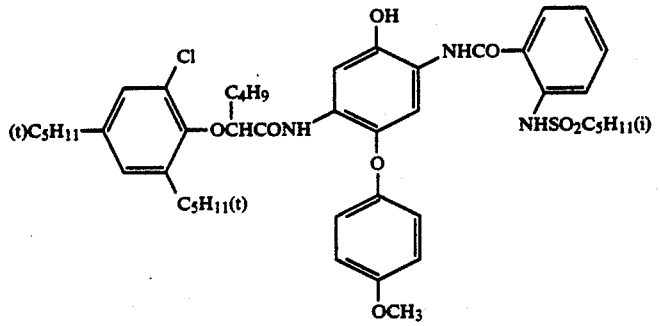

-continued
(I-19)
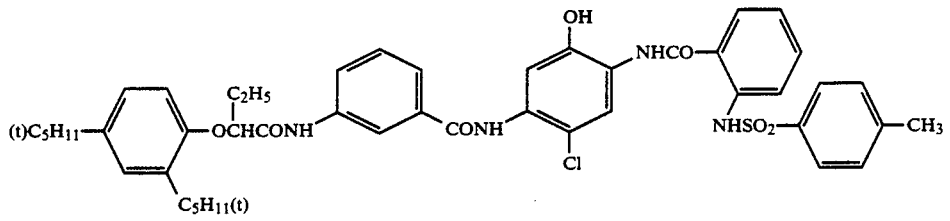
(I-20)
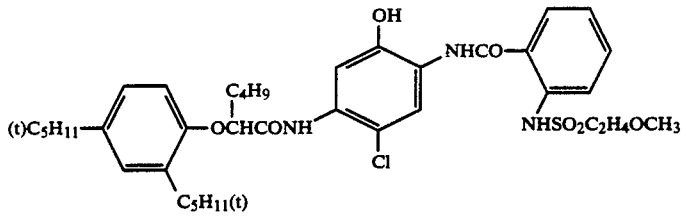
(I-21)
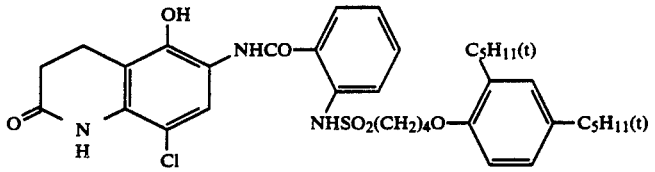
(I-22)
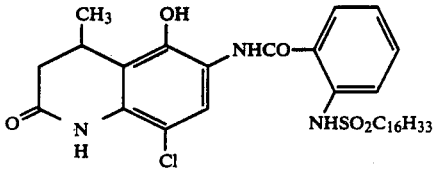
(I-23)
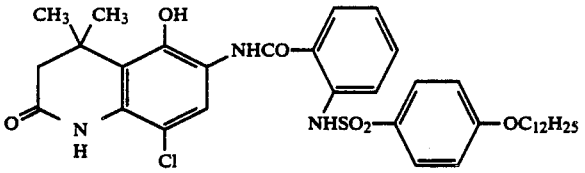
(I-24)
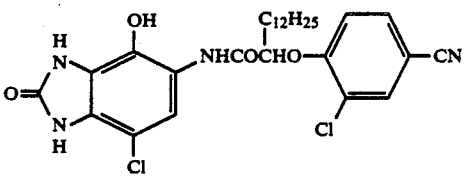
(I-25)
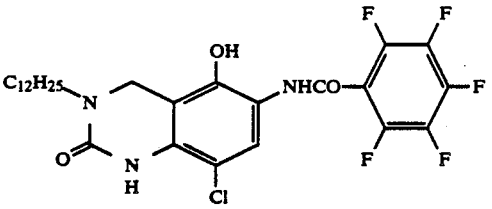
(I-26)
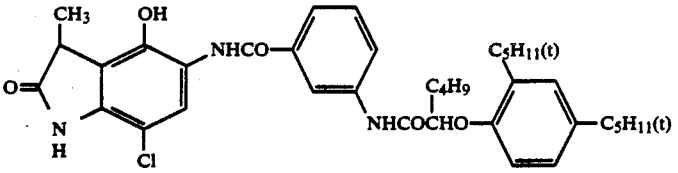

-continued
(I-27)
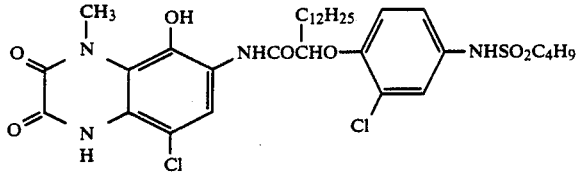
(I-28)
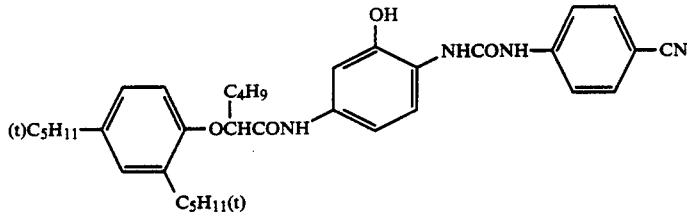
(I-29)
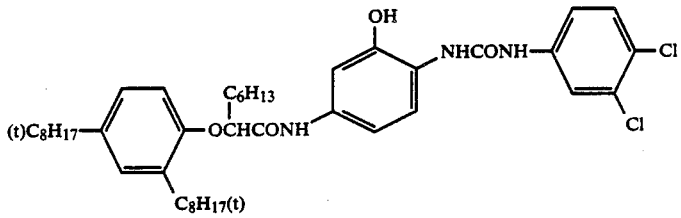
(I-30)
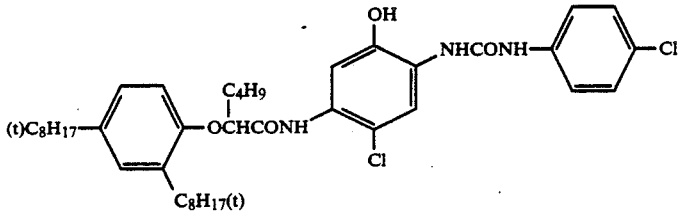
(I-31)
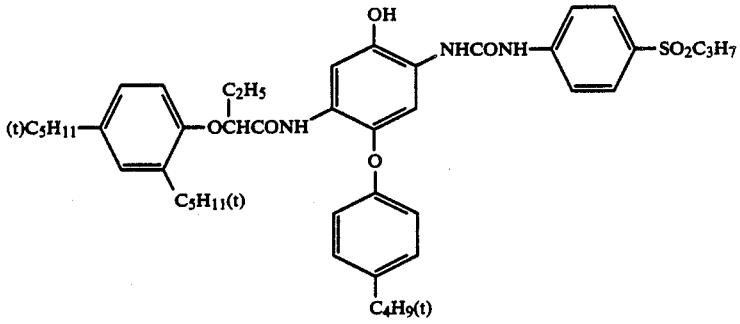
(I-32)
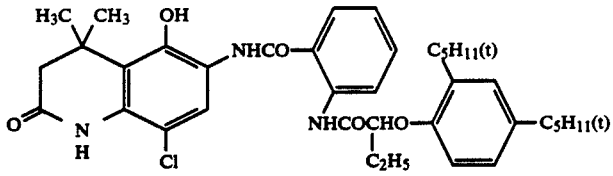
(I-33)
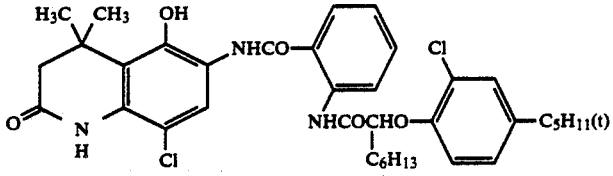

-continued
(I-34)
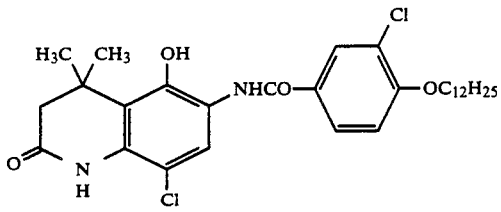
(I-35)
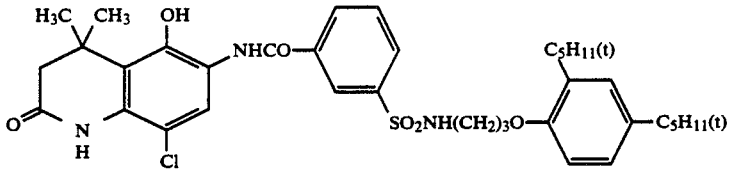
(I-36)
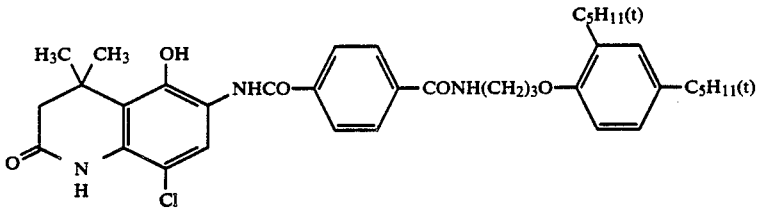
(I-37)
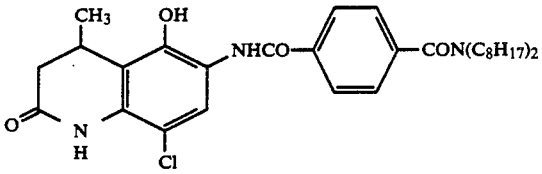
(I-38)
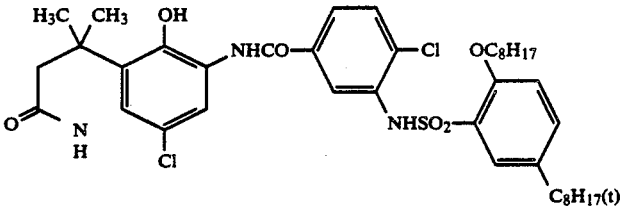
(I-39)
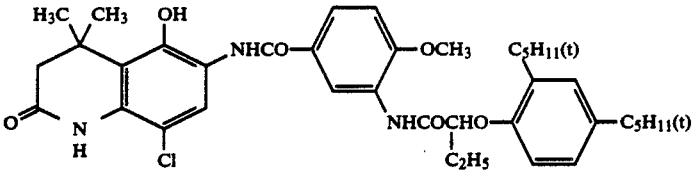
(I-40)
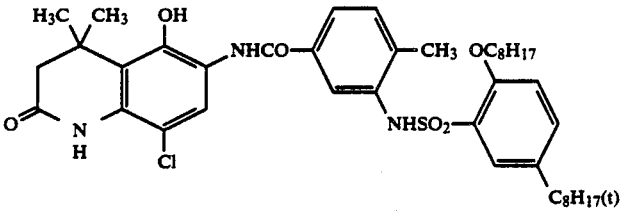

-continued
(I-41)
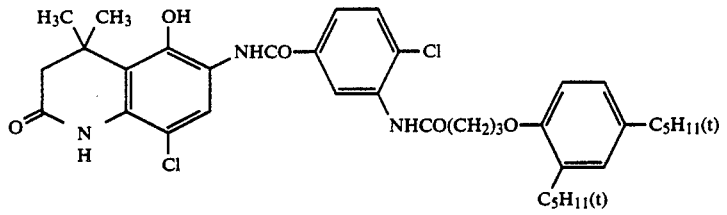
(I-42)
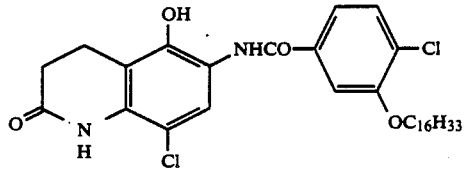
(I-43)
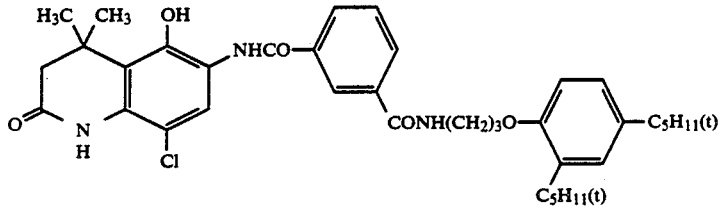
(I-44)
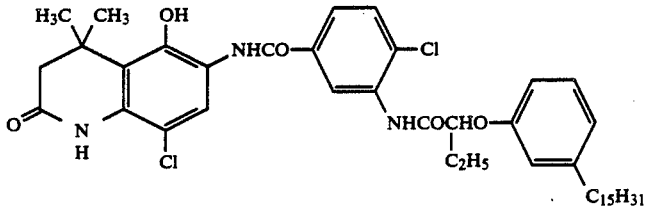
(I-45)
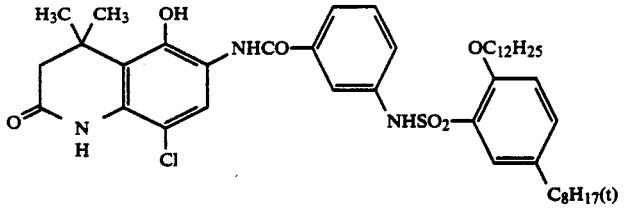
(I-46)
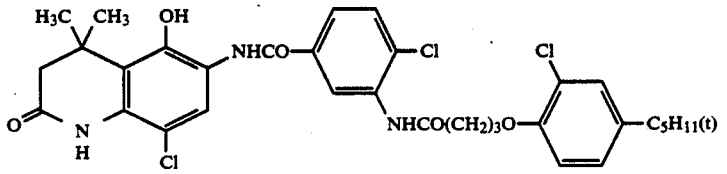
(II-1)
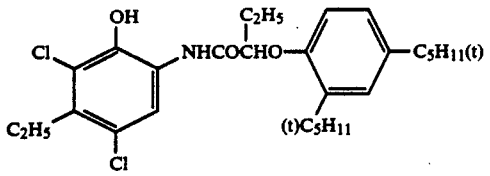
(II-2)
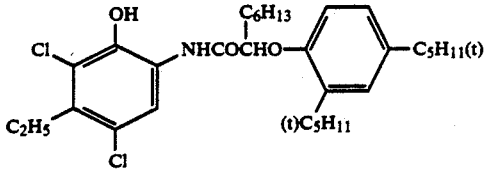

-continued
(II-3)
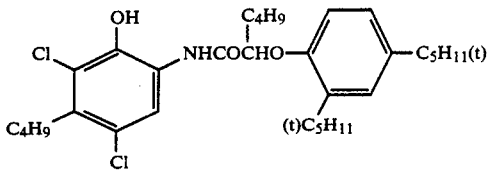
(II-4)
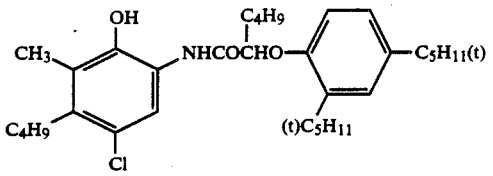
(II-5)
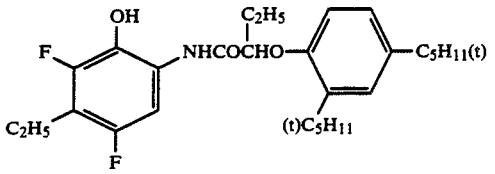
(II-6)
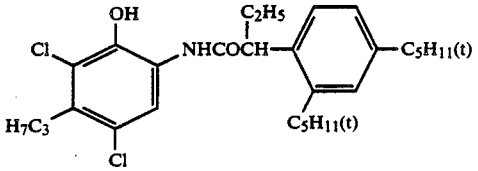
(II-7)
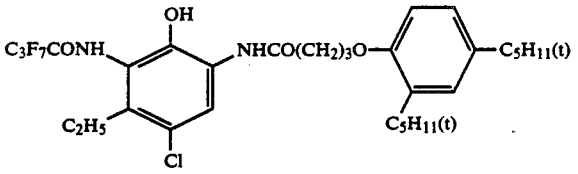
(II-8)
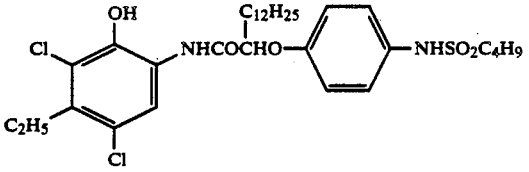
(II-9)
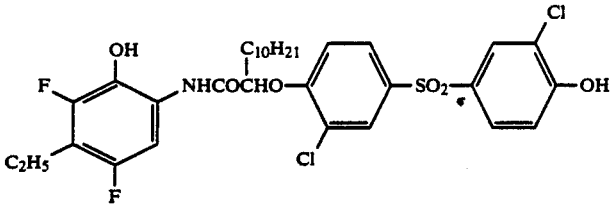
(II-10)
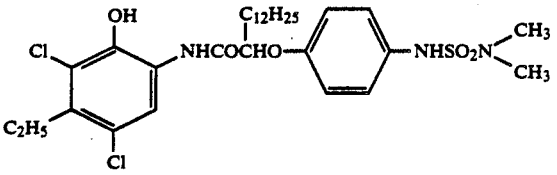

-continued
(II-11)
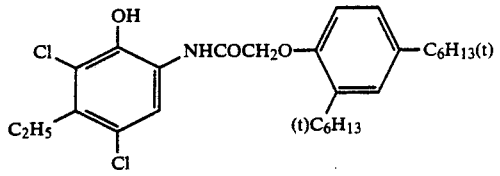
(II-12)
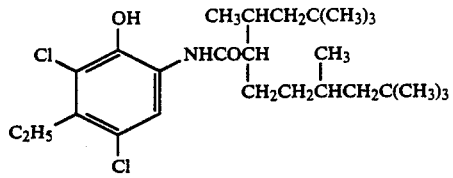
(II-13)
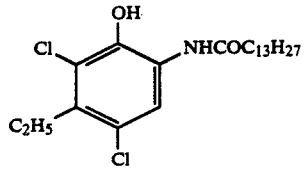
(II-14)
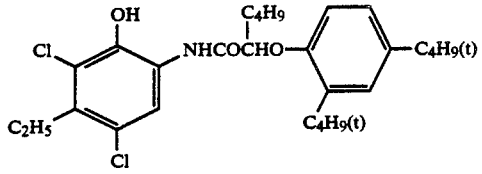
(II-15)
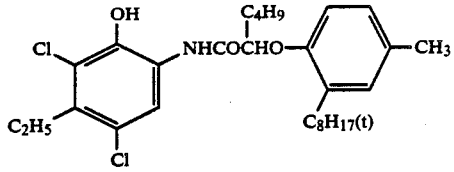
(II-16)
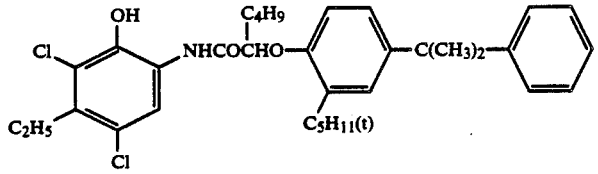
(II-17)
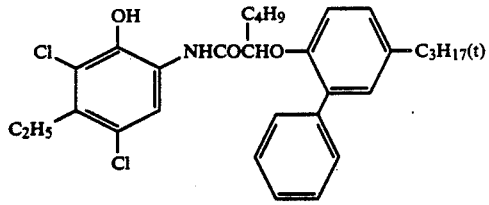
(II-18)
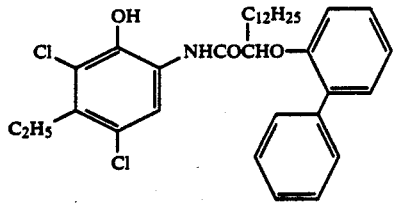

-continued (II-19)

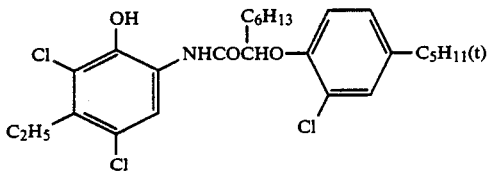

(II-20)

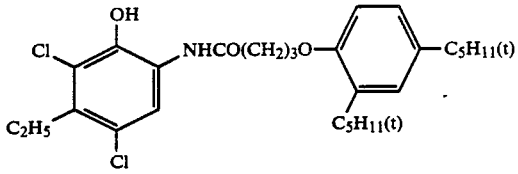

(II-21)

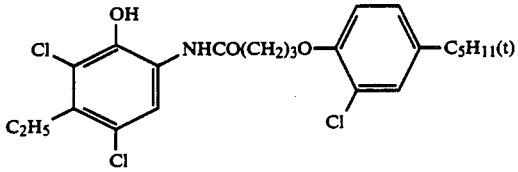

(II-22)

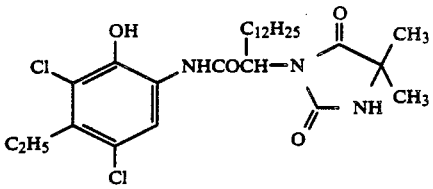

(II-23)

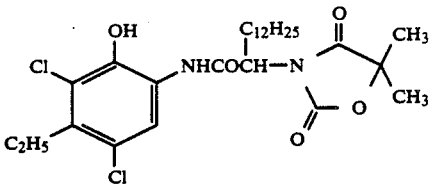

In general in formulae (III), as is well known in the field of organic chemistry, the ring

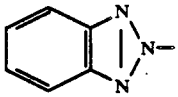

may form a benzotriazole ring

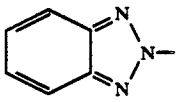

as its resonance structure.

U.S. Pat. Nos. 4,126,396, 4,334,011, 4,327,173, 4,430,423, 4,500,635, 4,564,586, etc., show how to synthesize the coupler compounds of formulae (I). U.S. Pat. No. 3,772,002 discloses how to synthesize the coupler compounds of formulae (II). Japanese Patent Application (OPI) No. 57,536/86 discloses how to synthesize compounds from which the coupler compounds of formulae (II) can be derived.

Typical examples of the compounds represented by the foregoing general formulae (III) and (IV) are illustrated below, although the present invention is not to be construed as being limited thereto.

(III-1)

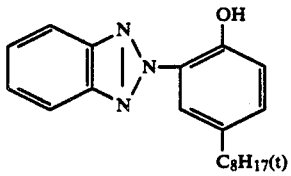

-continued
(III-2)
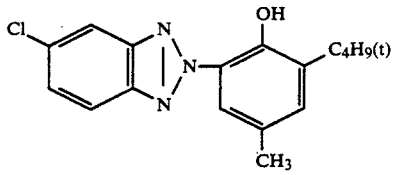
(III-3)
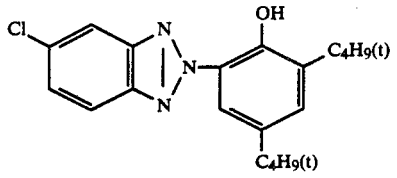
(III-4)
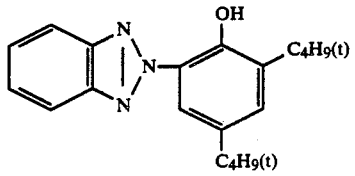
(III-5)
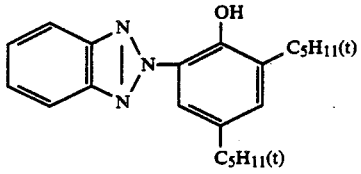
(III-6)
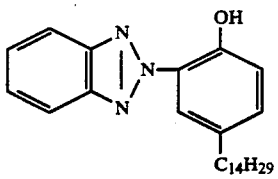
(III-7)
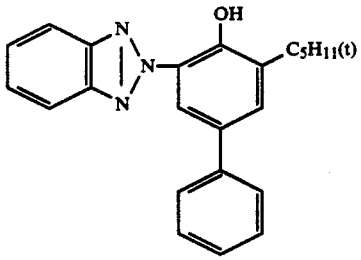
(III-8)
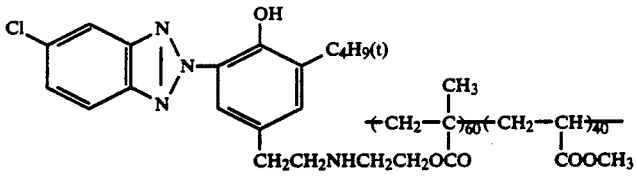
(III-9)
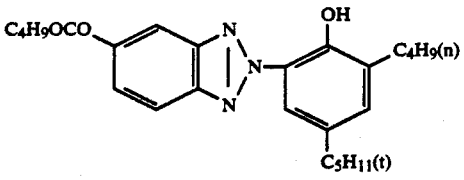

-continued
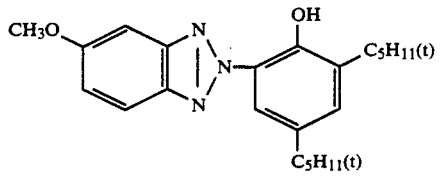
(III-10)
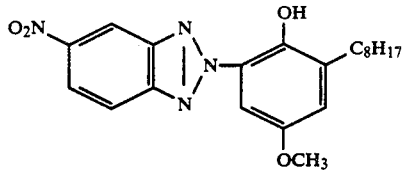
(III-11)
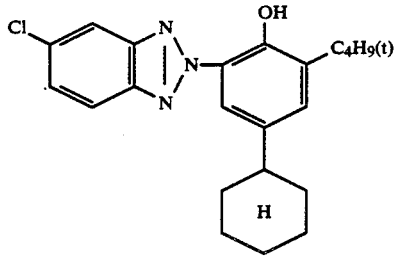
(III-12)
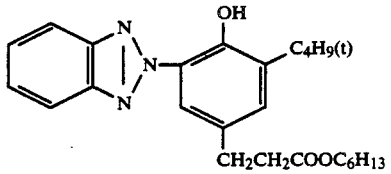
(III-13)
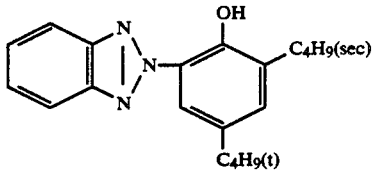
(III-14)
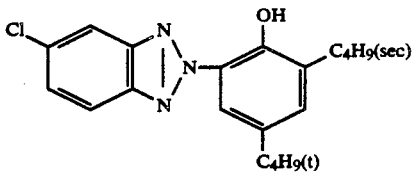
(III-15)
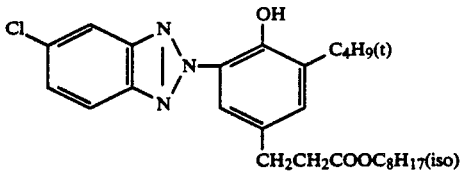
(III-16)
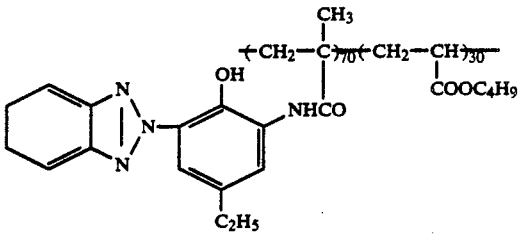
(III-17)

-continued
(III-18)
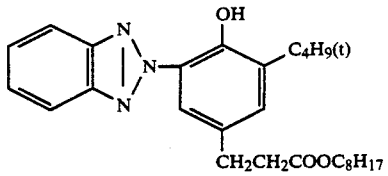
(III-19)
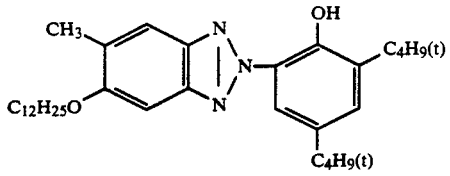
(IV-1)
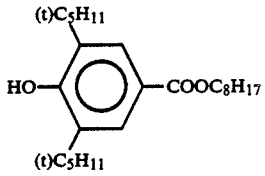
(IV-2)
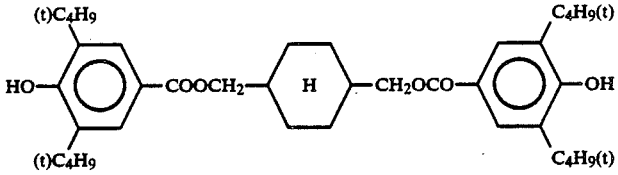
(IV-3)
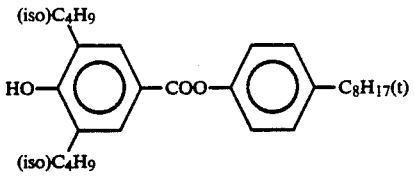
(IV-4)
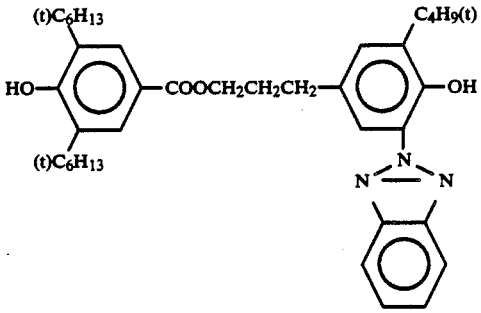
(IV-5)
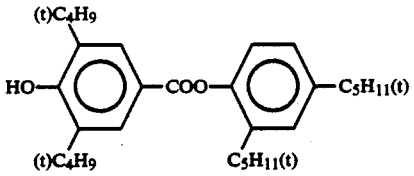
(IV-6)
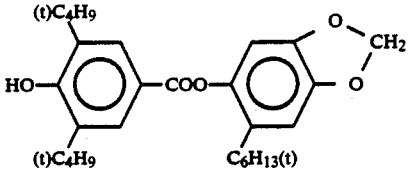

-continued
(IV-7)
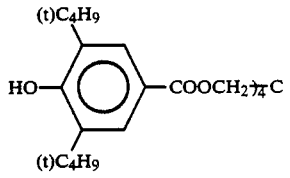
(IV-8)
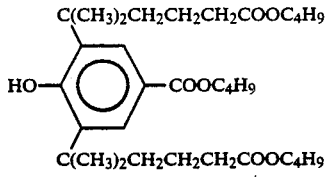
(IV-9)
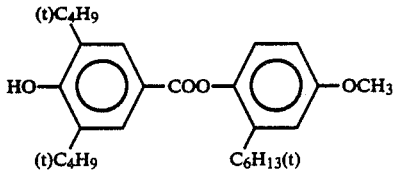
(IV-10)
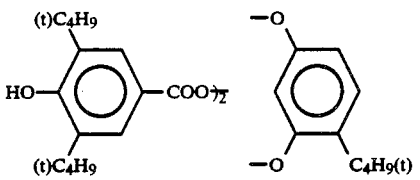
(IV-11)
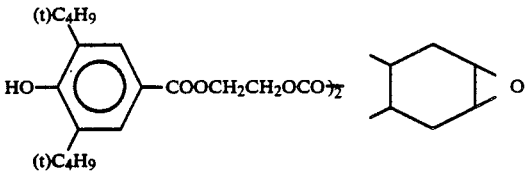
(IV-12)
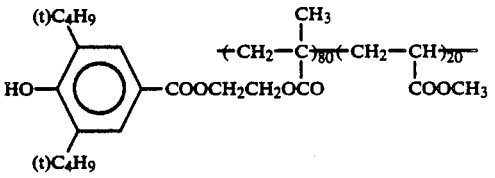
(IV-13)
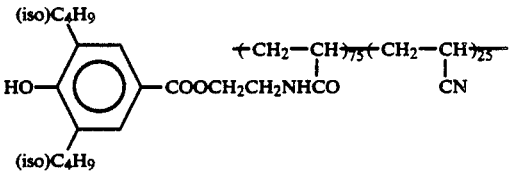
(IV-14)
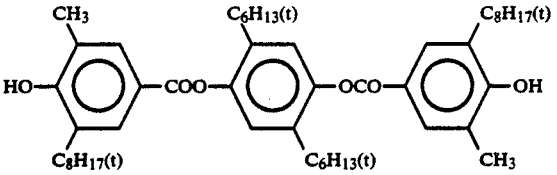
(IV-15)
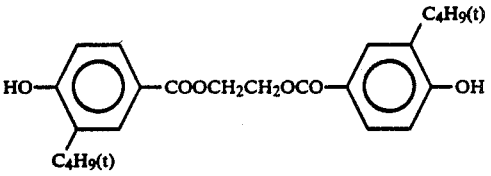

Processes for synthesizing the compounds represented by general formula (III) and other examples of the compounds are described in Japanese Patent Publication Nos. 29620/69, and 5934/62 Japanese Patent Application (OPI) Nos. 51149/75 and 95233/79, U.S. Pat. Nos. 3,766,205 and 3,761,272, European Patent 0057160 and *Research Disclosure,* 22519 (1983, No. 225). In addition, high molecular weight ultraviolet light absorbing agents described in Japanese Patent Application (OPI) No. 111942/83, Japanese Patent Application Nos. 61937/82, 63602/82, 129780/82 and 133371/82 may also be used, and may be used optionally in combination with low molecular weight ultraviolet light absorbing agents.

One compound represented by the formulae (III) which is commercially available in Tivunin (which is a trade name of Ciba-Geigy).

Processes for synthesizing the compounds represented by general formula (IV) and other examples of the compounds are described in U.S. Pat. Nos. 3,112,338, 3,168,492, 3,206,413.

Both the couplers used in the present invention and the compounds represented by general formulae (III) and (IV) are dissolved in a high boiling organic solvent, a low boiling organic solvent, or a mixed solvent thereof, and the resulting solution is dissolved in a hydrophilic colloid. They may be co-emulsified with the cyan couplers used.

In the present invention, the compounds represented by general formulae (III) and (IV) (ultraviolet light absorbing agents and antioxidants) may be added to any layer of the light-sensitive material in addition to being present in a layer containing the compound of general formula (I) and (II), in particular a layer adjacent a layer containing the compound of the general formulae (I) and (II).

Like the couplers, the above described ultraviolet light absorbing agents are typically dissolved in a single or mixed solvent of a high boiling organic solvent and a low boiling organic solvent, then dispersed in a hydrophilic colloid. The weight ratio of the high boiling organic solvent to the ultraviolet light absorbing agent is not particularly limited but, usually, the high boiling organic solvent is used in an amount of about 0% to 300% based on the weight of the ultraviolet light absorbing agent. Independent or combined use of compounds which are liquid at ordinary temperatures is preferred.

Preservability, particularly light fastness, of colored dye image, particularly cyan color image, can be greatly improved by using the ultraviolet light absorbing agent of general formula (III) together with the combination of couplers of the present invention.

The ultraviolet light absorbing agent is used in a sufficient amount to impart light stability to the cyan color image but, when used in excess, it can cause yellowing of the unexposed areas (white background) of the color photographic light-sensitive material Thus, it is generally used in an amount of about $1\times10^{-4}$ mol/m$^2$ to $2\times10^{-3}$ mol/m$^2$, particularly about $5\times10^{-4}$ mol/m$^2$ to $1.5\times10^{-3}$ mol/m$^2$.

In a layer structure of an ordinary photographic color paper according to the invention the ultraviolet light absorbing agent is incorporated in either, preferably both, of the layers adjacent to a cyan coupler-containing red-sensitive emulsion layer. When adding the ultraviolet light absorbing agent to an interlayer between a green-sensitive layer and a red-sensitive layer, it may be co-emulsified with a color stain preventing agent and, when adding the ultraviolet light absorbing agent to a protective layer, another protective layer may be provided as an outermost layer. The outermost protective layer may contain conventional additives, such as a matting agent.

The compounds represented by general formula (IV) may be used in a combination of two or more and, in addition, may be used together with yellow couplers or magenta couplers in combination with conventionally known anti-fading agents. The compounds are used in an amount of from about 5 to 200 mol % based on the total amount of the cyan color image forming couplers represented by general formulae (I) and (II).

In the present invention, yellow image forming couplers and magenta image forming couplers (hereinafter referred to as yellow couplers and magenta couplers, respectively) are not particularly limited, and any conventional yellow and magenta couplers may be used. For example, yellow couplers represented by the following general formula (V) may be used:

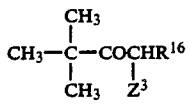

(V)

wherein:

$R^{16}$ represents an optionally substituted N-phenylcarbamoyl group; and $Z^3$ represents a hydrogen atom or a group capable of being eliminated by a coupling reaction with an oxidation product of a developing agent (i.e., a coupling-off group), with $Z^3$ optionally forming a dimer or larger polymer.

In general formula (V), substituents for the phenyl group in the N-phenylcarbamoyl group represented by $R^{16}$ may be freely selected from among the substituents defined above for $R^1$ and, when two or more substituents are present, they may be the same or different.

Preferred examples of $R^{16}$ are represented by the following general formula (Va):

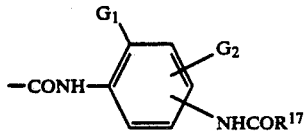

(Va)

wherein:

$G_1$ represents a halogen atom or an alkoxy group;

$G_2$ represents a hydrogen atom, a halogen atom or an optionally substituted alkoxy group; and $R^{17}$ represents an optionally substituted alkyl group.

Typical examples of the substituents for $G_2$ and $R^{17}$ in general formula (Va) include an alkyl group, an alkoxy group, an aryl group, an aryloxy group, an amino group, a dialkylamino group, a heterocyclic group (e.g., an N-morpholino group, an N-piperidino group or a 2-furyl group), a halogen atom, a nitro group, a hydroxy group, a carboxyl group, a sulfo group or an alkoxycarbonyl group.

Magenta couplers, which are not particularly limited, include "2-equivalent" magenta couplers wherein a substituent to be split off in a color developing step is introduced at the coupling active site of a pyrazolone type magenta coupler, described in U.S. Pat. Nos.

3,314,476, 3,419,391, 3,617,291 and 3,926,631. In addition, magenta couplers having a substituent in the coupling active site thereof connected by a sulfur atom may also be used. Examples of such magenta couplers include couplers having a thiocyano group (described in U.S. Pat. No. 3,214,437), couplers having an acylthio group or a thioacylthio group (described in U.S. Pat. No. 4,032,346), couplers having an arylthio group or a heterocyclic thio group (described in U.S. Pat. Nos. 3,227,554, 3,701,783 and Japanese Patent Publication No. 34044/78) and couplers having an alkylthio group (described in West German Patent Application (OLS) No. 2,944,601).

In addition, magenta couplers capable of releasing an arylthio group described in Japanese Patent Application (OPI) No. 35858/82 can be used.

Further, couplers of pyrazoloazole compounds described in U.S. Pat. No. 4,500,630, European Patent Publication (unexamined) No. 119860, *Research Disclosure,* Nos. 24531 (September, 1984), 24220 (June, 1984), 24230 (June, 1984) and 24620 (October, 1984), Japanese Patent Application (OPI) Nos. 33552/85 and 43659/85 may also be used. 1H-Pyrazolo[1,5-b][1,2,4]triazole couplers described in U.S. patent application Ser. No. 06/590,818 (filed Mar. 19, 1984) are most excellent in view of their absorption spectra, light and heat fastness and discoloration balance of the developed magenta dye.

Japanese Patent Application No. 27/745/84 which corresponds to published unexamined Japanese Patent Application 59-27745 filed Feb. 16, 1984 and U.S. Pat. No. 4,621,046 disclose pyrazolo (1,5-b)-1,2,4-triazole derivatives.

Documents describing the couplers to be used in the present invention, other illustrative compounds, and processes for synthesizing them are given below.

In addition to the aforesaid documents, magenta couplers are described in Japanese Patent Application (OPI) Nos. 111631/74 and 126833/81, and U.S. Pat. No. 4,351,897, and yellow couplers are described in Japanese Patent Application (OPI) No. 48541/79, Japanese Patent Publication No. 10739/83, U.S. Pat. No. 4,326,024 and *Research Disclosure,* 18053.

Highly color forming ballast groups, which are described in Japanese Patent Application (OPI) Nos. 42045/83, 214839/84 and 177557/84, and U.S. Pat. Nos. 4,503,141 and 4,513,082, may be bonded to any of the aforesaid coupler compounds. Of significant importance are yellow couplers which have a moiety described in U.S. Pat. No. 4,513,082 in a group capable of being eliminated by a coupling reaction. Preferred examples of general formula (V) of the present invention correspond to the couplers represented by general formula (II) of U.S. Pat. No. 4,513,082 which is shown as general formula (Vb):

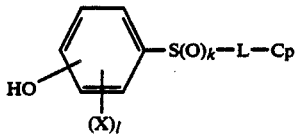

(Vb)

where Cp represents a coupler residue, L represents a bond or a divalent linking group, X represents a halogen atom, an alkyl group, an aryl group, a heterocyclic group, a hydroxyl group, an alkoxy group, an aryloxy group, an acylamino group, a sulfonamido group, a carbamoyl group, a sulfamoyl group, a ureido group, an alkoxycarbonyl group, an alkoxycarbonylamino group, a sulfonyl group, an alkylthio group, a cyano group, a nitro group or a carboxy group, l represents an integer of 1 to 4, and k represents an integer of 1 or 2.

The aforementioned cyan, yellow or magenta coupler to be used in the present invention is incorporated in a light-sensitive silver halide emulsion layer, usually in an amount of about 0.1 to 1.0 mol, preferably about 0.1 to 0.5 mol, per mol of silver halide, respectively. Typically, the weight ratio of cyan : magenta : yellow couplers usually falls within the range of about 1:0.2–1.5:0.5–1.5. However, ratios outside this range may be employed in designing the light-sensitive material.

In the present invention, the cyan couplers are used in such amounts that the coupler represented by general formula (II) is used in an amount of about 0.1 to 10 mols, preferably about 0.2 to 5 mols, per mol of the coupler represented by general formula (I).

In the present invention, the method of adding the aforesaid couplers to light-sensitive layers is nor unduly limited, and various known techniques may be applied. Typically, the couplers may be added according to the oil-in-water dispersing process, known as the "oil protect" process. For example, they are first dissolved in a single or mixed solvent of a high boiling organic solvent (e.g., a phthalic ester such as dibutyl phthalate or dioctyl phthalate, a phosphoric ester such as tricresyl phosphate or trinonyl phosphate), or a low boiling organic solvent (e.g., ethyl acetate), then emulsified and dispersed in a gelatin aqueous solution containing a surfactant. Alternatively, water or a gelatin aqueous solution may be added to a coupler solution containing a surfactant, followed by phase conversion to prepare an oil-in-water dispersion. Further, alkali-soluble couplers may also be dispersed according to the Fischer dispersion process. The coupler dispersion may be mixed with a photographic emulsion after the low boiling organic solvent is removed by distillation, noodle washing, ultrafiltration, or the like.

Special couplers other than the aforementioned couplers may be incorporated, if desired, in the color photographic light-sensitive material of the present invention. For example, a colored magenta coupler may be incorporated in a green-sensitive emulsion layer to obtain a masking effect. A development inhibitor releasing coupler (DIR coupler) or a development inhibitor releasing hydroquinone may be used in emulsion layers of respective sensitivities or adjacent layers thereto. The development inhibitor to be released from these compounds upon development provides an interimage effect of improving sharpness of image, fineness of image or saturation of a single color.

Couplers capable of releasing a development accelerator or a nucleating agent upon development of silver may be added to a photographic emulsion layer or an adjacent layer of the color photographic light-sensitive material of the present invention to improve photographic sensitivity and graininess of the color image, and to increase the contrast of gradation.

Various silver halides may be used in the silver halide emulsion layer of the color photographic light-sensitive material in accordance with the present invention. For example, any of silver chloride, silver bromide, silver chlorobromide, silver bromoiodide or silver chlorobromoiodide can be used. Silver bromoiodide containing about 2 to 20 mol % of silver iodide and silver chlorobromide containing about 10 to 50 mol % of silver bromide are preferred. Silver halide grains are not particularly limited as to crystal form, crystal structure, grain size or grain size distribution. The silver halide crystals may either have normal crystal form or twin crystal form, and may have any of hexahedral, octahedral or tetradecahedral forms. Tabular grains of about 0.5 μm or less in thickness, at least about 0.6 μm in diameter, and about 5 or more in average aspect ratio described in *Research Disclosure,* 22534 may also be employed.

Silver halide grains may have a uniform structure or a structure in which the internal portion and the external portion differ in composition from each other, may have a layered structure or a structure in which silver halides of different compositions are joined to each other by epitaxial junction, or may comprise a mixture of grains of various crystal forms. Either silver halide grains forming a latent image primarily on the grain surface or silver halide grains forming an image in the interior of the grains may be used.

The silver halide grains may have a grain size as small as about 0.1 μm or less or as large as about 3 μm in projected area diameter, and either monodisperse emulsions having a narrow distribution of grain size or polydisperse emulsions having a wide distribution may be used.

These silver halide grains may be prepared according to processes conventionally employed in the art.

The silver halide emulsion may be sensitized by conventional chemical sensitization, i.e., using a sulfur sensitization process, a noble metal sensitization process, or a combination thereof. Further, the silver halide emulsion in accordance with the present invention may be spectrally sensitized to a desired light wavelength region using a sensitizing dye or dyes. Dyes which are advantageously used in the present invention include methine dyes and styryl dyes, such as cyanines, hemicyanines, rhodacyanines, merocyanines, oxonols and hemioxonols, and may be used alone or in a combination of two or more.

As the support used in the present invention, any conventional transparent supports such as polyethylene terephthalate and cellulose triacetate, or conventional reflective supports may be used. Reflective supports are preferable, and include baryta paper, polyethylene coated paper, polypropylene type synthetic paper, transparent supports having a reflective layer or using a reflective substance in combination such as glass plates, polyester films (e.g., polyethylene terephthalate film, cellulose triacetate film or cellulose nitrate film), polyamide film, polycarbonate film or polystyrene film. These supports may easily be selected by one of ordinary skill in the art according to the end-use.

Each of the blue-sensitive, green-sensitive and red-sensitive emulsions is spectrally sensitized with methine dyes or the like to provide its sensitivity. Dyes used include cyanine dyes, merocyanine dyes, complex merocyanine dyes, complex cyanine dyes, holopolar cyanine dyes, hemicyanine dyes, styryl dyes, and hemioxonols, with cyanine dyes, merocyanine dyes, and complex merocyanine dyes being particularly useful.

In addition to the above described constituent layers, the color photographic light-sensitive material of the present invention may have auxiliary layers such as a subbing layer, an interlayer or a protective layer. If necessary, a second ultraviolet light absorbing layer may be provided between the red-sensitive silver halide emulsion layer and the green-sensitive silver halide emulsion layer. The aforementioned ultraviolet light absorbing agents are preferably used in this ultraviolet light absorbing layer, though other known ultraviolet light absorbing agents may also be used.

Although gelatin is advantageously used as the binder or protective colloid for the photographic emulsions used in this invention, other hydrophilic colloids may also be used in this invention. For example, proteins such as gelatin derivatives, graft polymers of gelatin with other high molecular weight materials, albumin or casein, cellulose derivatives such as hydroxyethyl cellulose, carboxymethyl cellulose or cellulose sulfate, saccharide derivatives such as sodium alginate or starch derivatives, and synthetic hydrophilic high molecular weight materials such as homo- or copolymers, for example, polyvinyl alcohol, polyvinyl alcohol partial acetal, poly-N-vinylpyrrolidone, polyacrylic acid, polymethacrylic acid, polyacrylamide, polyvinylimidazole or polyvinylpyrazole can be used.

As gelatin, acid-processed gelatin or enzyme-processed gelatin as described in *Bull. Soc. Sci. Phot. Japan,* No. 16, p. 30 (1966) may be used as well as lime-processed gelatin, and a gelatin hydrolyzate or an enzyme-decomposed product can be used.

The light-sensitive material of the present invention may contain in its photographic emulsion layers or other hydrophilic colloidal layers brightening agents of the stilbene type, triazine type, oxazole type or coumarin type. They may be water-soluble, and if water-insoluble, may be used as dispersion. Specific examples of the fluorescent brightening agents are described in U.S. Pat. Nos. 2,632,701, 3,269,840, 3,359,102, British Patents 852,075, 1,319,763 and *Research Disclosure,* Vol. 176, 17643 (December, 1978), p. 24, left col., lines 9 to 36 (description of brighteners).

When incorporating dyes or ultraviolet light absorbing agents in the hydrophilic colloidal layer of the light-sensitive material of the present invention, they may be mordanted with cationic polymers For example, polymers described in British Patent 685,475, U.S. Pat. Nos. 2,675,316, 2,839,401, 2,882,156, 3,048,487, 3,184,309, 3,445,231, West German Patent Application (OLS) No. 1,914,362, Japanese Patent Application Nos. 47624/75 and 71332/75 may be used.

The light-sensitive material of the present invention may contain, as color fog preventing agents, hydroquinone derivatives, aminophenol derivatives, gallic acid derivatives or ascorbic acid derivatives, specific examples of which are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77 and Japanese Patent Publication No. 23813/75.

To the color photographic light-sensitive material of the present invention may be added, if desired, various photographic additives such as stabilizers, antifoggants, surfactants, couplers outside the scope of the present invention, filter dyes, anti-irradiation dyes, and developing agents known in the art, in addition to the above described additives, examples of which are described in *Research Disclosure,* 17643.

Further, in some cases, fine grained silver halide emulsions having substantially no light sensitivity (for example, a silver chloride emulsion, a silver bromide emulsion or a silver chlorobromide emulsion having an average grain size of about 0.20 μm or less) may be added to the silver halide emulsion layers or other hydrophilic colloidal layers.

A color developer to be used in the present invention is preferably an alkaline aqueous solution containing an aromatic primary amine color developing agent as a major component. Typical examples of the color developing agents include 4-amino-N,N-diethylaniline, 3-methyl-4-N,N-diethylaniline, 4-amino-N-ethyl-N-β-hydroxyethylaniline, 3-methyl-4-amino-N-ethyl-β-hydroxyethylaniline, 3-methyl-4-amino-N-ethyl-N-β-methanesulfonamidoethylaniline and 4-amino-3-methyl-N-ethyl-N-β-methoxyethylaniline.

The color developer may contain a pH buffer such as an alkali metal sulfite, carbonate, borate or phosphate, a development restrainer or antifogging agent such as a bromide, an iodide or an organic antifogging agent. If desired, the color developer may further contain a water softener, a preservative such as hydroxylamine, an organic solvent such as benzyl alcohol or diethylene glycol, a development accelerator such as polyethylene glycol, a quaternary ammonium salt or an amine, a dye forming coupler, a competitive coupler, a fogging agent such as sodium borohydride, an auxiliary developing agent such as 1-phenyl-3-pyrazolidone, a viscosity imparting agent, a polycarboxylic acid chelating agent described in U.S. Pat. No. 4,083,723 or an antioxidant described in West German Patent Application (OLS) No. 2,622,950.

After color development, photographic emulsion layers are usually bleached. Bleaching may be effected either simultaneously with fixing, or independently. As bleaching agents, compounds of polyvalent metals such as iron (III), cobalt (III), chromium (VI), copper (II), peracids, quinones and nitroso compounds are used. For example, ferricyanates, dichromates, organic complex salts of iron (III) or cobalt (III) such as complexes of aminopolycarboxylic acids (e.g., ethylenediaminetetraacetic acids, nitrilotriacetic acid or 1,3-diamino-2-propanol tetraacetic acid) or organic acids (e.g., citric acid, tartaric acid or malic acid), persulfates, permanganates or nitrosophenol may be used. Of these, potassium ferricyanate, iron (III) sodium ethylenediaminetetraacetate and iron (III) ammonium ethylenediaminetetraacetate are particularly useful. Iron (III) ethylenediaminetetraacetates are useful in both an independent bleaching solution and a monobath bleach-fixing solution.

The color development processing or the bleach-fixing processing may be followed by washing with water. Color development may be effected at any temperature between about 18° C. and 55° C., preferably at about 30° C. or above, particularly preferably at about 35° C. or above. Developing time is typically about 3½ minutes to about 1 minute, and the shorter the better. In continuous development processing, it is preferable to replenish the developer, and the replenishing solution is added in an amount of about 330 cc to 160 cc, preferably up to about 100 cc, per $m^2$ of processed area of light-sensitive materials. Concentration of benzyl alcohol in the developer is preferably about 5 ml/liter or less than that.

Bleach-fixing may be conducted at any temperature between about 18° C. and 50° C., preferably at about 30° C. or above. When bleach-fixing is conducted at about 35° C. or above, processing time can be shortened to about 1 minute or less, and the amount of replenishing solution can be reduced. Washing with water after color development or bleach-fixing is usually conducted for about 3 minutes or less, and may be conducted within 1 minute using a stabilizing bath.

Developed dyes are deteriorated and faded by fungi during storage as well as by light, heat or humidity. Cyan color images in particular are deteriorated by fungi, and hence the use of antifungal agents is preferable. Specific examples of the antifungal agents include 2-thiazolylbenzimidazoles as described in Japanese Patent Application (OPI) No. 157244/82. The antifungal agents may be incorporated in light-sensitive materials, may be added to the solution in the developing step, or may be added to processed light-sensitive materials at any step.

The silver halide color photographic light-sensitive material of the present invention has good color forming properties and provides color photographic images having excellent color reproducibility. It has such an improved image stability that the resulting image does not undergo substantial change in color balance when exposed to light or kept in the dark for a long time. Further, the light-sensitive material of the present invention provides color photographic images with good image preservability when stored for a long time under conditions of high temperature or high humidity, and which do not exhibit change in color balance either in highly colored areas or in areas with gradation. Still further, the light-sensitive material of the present invention has improved light fastness as well as improved preservability.

The present invention is now illustrated in greater detail by reference to the following examples which, however, are not to be construed as limiting the present invention in any way. Unless otherwise indicated, all parts, percents and ratios are by weight.

EXAMPLE 1

First layer (bottom layer) to sixth layer (uppermost layer) were coated in sequence on polyethylene double laminated paper as described in Tables I and II to prepare color photographic light-sensitive materials (Samples A to Z).

The coating solution for the first layer was prepared as follows. 100 g of each yellow coupler shown in Table I was dissolved in a mixed solution of 166.7 ml of dibutyl phthalate (DBP) and 200 ml of ethyl acetate, and the resulting solution was emulsified and dispersed in 800 g of a 10% gelatin aqueous solution containing 80 ml of a 1% sodium dodecylbenzenesulfonate aqueous solution Then, the whole amount of the thus prepared emulsion dispersion was mixed with 1,450 g of a blue-sensitive silver bromochloride emulsion (Br: 80%) (containing 66.7 g of Ag) to prepare the coating solution. Coating layers for forming other layers were prepared in the same manner. As a hardener for each layer, 2,4-dichloro-6-hydroxy-s-triazine sodium salt was used. The following spectral sensitizing agents were used for respective emulsions.

Blue-Sensitive Emulsion Layer: 3,3'-di(γ-sulfopropyl)-selenacyanine sodium salt ($2\times10^{-4}$ mol per mol of silver halide)

Green-Sensitive Emulsion Layer: 3,3'-di(γ-sulfopropyl)-5,5'-diphenyl-9-ethyloxacarbocyanine sodium salt ($2.5\times10^{-4}$ mol per mol of silver halide)

Red-Sensitive Emulsion Layer: 3,3'-di(γ-sulfopropyl)-9-methyl-thiadicarbocyanine sodium salt ($2.5\times10^{-4}$ mol per mol of silver halide)

As irradiation preventing dyes, the following dyes were used.

Green-Sensitive Emulsion Layer:

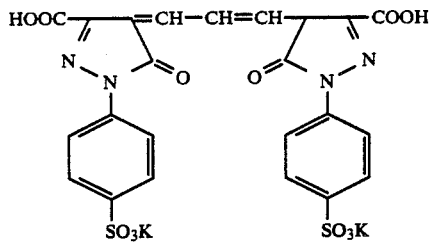

Red-Sensitive Emulsion Layer:

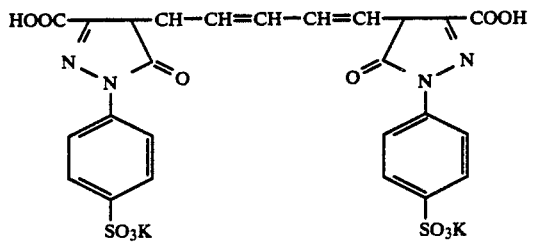

TABLE I

| | | |
|---|---|---|
| Sixth Layer (protective layer) | Gelatin | 1,500, mg/m$^2$ |
| Fifth Layer (red-sensitive layer) | AgClBr emulsion (AgBr:50 mol %) | 300 mg Ag/m$^2$ |
| | Cyan coupler | Table II |
| | UV light absorbing agents | Table II |
| | Fading preventing agent | Table II |
| | Solvent for cyan couplers (DBP) | 240 mg/m$^2$ |
| | Gelatin | 600 mg/m$^2$ |
| Fourth Layer (UV light absorbing layer) | UV light absorbing agents (III-3/III-1/III-4) | 15/45/90 mg/m$^2$ |
| | Solvent for UV light absorbing agent (DBP) | 60 mg/m$^2$ |
| | Gelatin | 1,000 mg/m$^2$ |
| Third Layer (green-sensitive layer) | AgClBr emulsion (AgBr: 70 mol %) | 450 mg Ag/m$^2$ |
| | Magenta coupler (*a) | 350 mg/m$^2$ |
| | Fading preventing agents (*b/*c) | 50/100 mg/m$^2$ |
| | Magenta coupler solvent (TOP) | 440 mg/m$^2$ |
| | Gelatin | 1,000 mg/m$^2$ |
| Second Layer (color stain (preventing layer) | Gelatin | 1,500 mg/m$^2$ |
| First Layer (blue-sensitive layer) | AgClBr emulsion (AgBr: 80 mol %) | 400 mg Ag/m$^2$ |
| | Yellow coupler (*d) | 600 mg/m$^2$ |
| | Yellow coupler solvent (DBP) | 1,000 mg/m$^2$ |

TABLE I-continued

| | | |
|---|---|---|
| | Gelatin | 1,200 mg/m$^2$ |
| Support | Polyethylene double laminated paper support | |

TABLE II

| Sample Name | Cyan Coupler | UV Light-Absorbing Agent or Fading-Preventing Agent In 5th Layer | Note |
|---|---|---|---|
| A | I-11 580 mg/m$^2$ | — | Comparison |
| B | I-11 580 mg/m$^2$ | III-3/III-4 40/60 mg/m$^2$ | Comparison |
| C | I-11 580 mg/m$^2$ | IV-5 200 mg/m$^2$ | Comparison |
| D | II-1 400 mg/m$^2$ | — | Comparison |
| E | II-1 400 mg/m$^2$ | III-3/III-4 40/60 mg/m$^2$ | Comparison |
| F | II-4 400 mg/m$^2$ | IV-5 200 mg/m$^2$ | Comparison |
| G | I-11/II-1 290/200 mg/m$^2$ | — | Comparison |
| H | I-11/II-1 290/200 mg/m$^2$ | III-3/III-4 40/60 mg/m$^2$ | Present Invention |
| I | I-11/II-1 290/200 mg/m$^2$ | IV-5 200 mg/m$^2$ | Present Invention |
| J | I-11/II-1 290/200 mg/m$^2$ | III-3/III-4/IV-5 40/60/100 mg/m$^2$ | Present Invention |
| K | I-11/II-1 290/200 mg/m$^2$ | III-14/III-15 60/40 mg/m$^2$ | Present Invention |
| L | I-11/II-1 290/200 mg/m$^2$ | III-14/III-15/IV-9 60/40/100 mg/m$^2$ | Present Invention |
| M | I-11/II-1 290/200 mg/m$^2$ | IV-11 200 mg/m$^2$ | Present Invention |
| N | I-5/II-1 250/200 mg/m$^2$ | — | Comparison |
| O | I-5/II-1 250/200 mg/m$^2$ | III-13/III-4 50/60 mg/m$^2$ | Present Invention |
| P | I-5/II-1 250/200 mg/m$^2$ | IV-11 250 mg/m$^2$ | Present Invention |
| Q | I-38/II-13 300/180 mg/m$^2$ | — | Comparison |
| R | I-38/II-13 300/180 mg/m$^2$ | III-13 100 mg/m$^2$ | Present Invention |
| S | I-38/II-13 300/180 mg/m$^2$ | III-13/IV-2 100 mg/100 mg | Present Invention |
| T | I-10/II-1 260/200 mg/m$^2$ | — | Comparison |
| U | I-10/II-1 260/200 mg/m$^2$ | III-3/III-4 40/60 mg/m$^2$ | Present Invention |
| V | I-11/II-3 290/210 mg/m$^2$ | — | Comparison |
| W | I-11/II-3 290/210 mg/m$^2$ | III-16 100 mg/m$^2$ | Present Invention |
| X | I-11/II-3 290/210 mg/m$^2$ | III-3/III-4/III-5 40/50/10 mg/m$^2$ | Present Invention |
| Y | I-46/II-21 300/190 mg/m$^2$ | — | Comparison |
| Z | I-46/II-21 300/190 mg/m$^2$ | III-3/III-4/IV-5 40/60/100 mg/m$^2$ | Present Invention |

In Table I, DBP means dibutyl phthalate, TOP means tri(n-octyl phthalate), and compounds *a to *d have the following chemical structures:

(*a) Magenta Coupler:

-continued

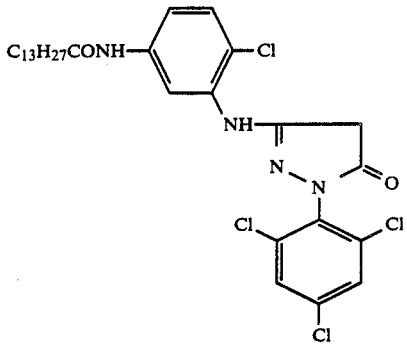

(*b) Fading Preventing Agent:

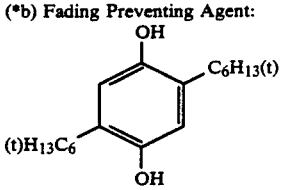

(*c) Fading Preventing Agent:

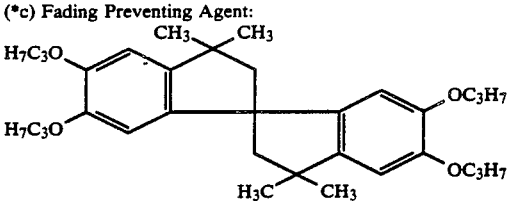

(*d) Yellow Coupler:

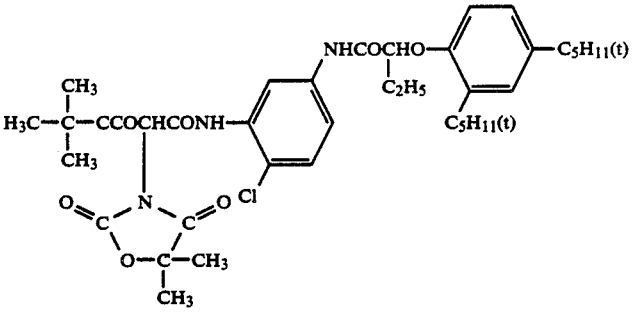

Each of these samples was subjected to gradation exposure (in such manner that the resulting image contained a portion with a color density of 1.0 in gray color) using an enlarger, Fuji Color Head 690 (made by Fuji Photo Film Co., Ltd.), then was development processed according to the following steps:

| Processing Step | Temperature (°C.) | Time |
|---|---|---|
| Development | 33 | 3 min 30 sec |
| Bleach-fixing | 33 | 1 min 30 sec |
| Washing with water | 28-35 | 3 min |

Formulations of the processing solutions used were as follows.

| | |
|---|---|
| Developer | |
| Benzyl alcohol | 15 ml |
| Diethylene glycol | 8 ml |
| Disodium ethylenediaminetetraacetate | 5 g |
| Sodium sulfite | 2 g |

-continued

| | |
|---|---|
| Hydroxylamine sulfate | 3 g |
| 4-Amino-N-ethyl-N-(β-methanesulfonamido-ethyl)-m-toluidine 2/3 sulfate monohydrate | 5 g |
| Water to make | 1,000 ml |
| pH adjusted to | 10.20 |
| Bleach-Fixing Solution | |
| Disodium ethylenediaminetetraacetate | 2 g |
| Ferric ethylenediaminetetraacetate | 40 g |
| Sodium sulfite | 5 g |
| Ammonium thiosulfate | 70 g |
| Water to make | 1,000 ml |
| pH adjusted to | 6.80 |

Each of the thus processed samples was subjected to a color fading test under the following conditions: (1) irradiation for 6 days with a xenon tester (illuminance: 130,000 lux); (2) storage in the dark at 80° C. for 4 weeks; and (3) storage in the dark for 8 weeks at 60° C., 70% RH.

The density of each sample after the color fading test was measured at the portion which had a density of 1.0 before the test, using a densitometer, Macbeth RD-514. The results obtained are tabulated in Table III.

TABLE III

| Sample No. | Irradiation with Xenon Light for 6 Days | | | 80° C., 4 Weeks | | | 60° C., 70% RH 8 Weeks | | |
|---|---|---|---|---|---|---|---|---|---|
| | $D_B$ | $D_G$ | $D_R$ | $D_B$ | $D_G$ | $D_R$ | $D_B$ | $D_G$ | $D_R$ |
| A (Comparison) | 0.75 | 0.69 | 0.48 | 1.00 | 0.99 | 0.98 | 0.97 | 0.98 | 0.95 |
| B (Comparison) | 0.78 | 0.74 | 0.52 | 0.99 | 0.99 | 0.97 | 0.97 | 0.98 | 0.94 |
| C (Comparison) | 0.76 | 0.70 | 0.49 | 0.99 | 0.99 | 0.96 | 0.98 | 0.98 | 0.93 |
| D (Comparison) | 0.75 | 0.70 | 0.68 | 1.00 | 0.99 | 0.80 | 0.98 | 0.98 | 0.78 |
| E (Comparison) | 0.78 | 0.74 | 0.71 | 0.99 | 0.99 | 0.83 | 0.97 | 0.99 | 0.80 |
| F (Comparison) | 0.76 | 0.70 | 0.68 | 1.00 | 1.00 | 0.82 | 0.98 | 0.99 | 0.79 |
| G (Comparison) | 0.74 | 0.69 | 0.67 | 0.99 | 0.99 | 0.92 | 0.97 | 0.97 | 0.89 |
| H (Present Invention) | 0.83 | 0.80 | 0.84 | 1.00 | 0.99 | 0.98 | 0.98 | 0.99 | 0.96 |
| I (Present Invention) | 0.80 | 0.79 | 0.84 | 1.00 | 1.00 | 0.97 | 0.98 | 0.98 | 0.95 |
| J (Present Invention) | 0.81 | 0.83 | 0.87 | 0.99 | 0.98 | 0.96 | 0.97 | 0.97 | 0.97 |
| K (Present Invention) | 0.82 | 0.82 | 0.85 | 0.99 | 0.99 | 0.95 | 0.98 | 0.99 | 0.98 |
| L (Present Invention) | 0.83 | 0.84 | 0.87 | 0.98 | 0.98 | 0.97 | 0.98 | 0.99 | 0.95 |
| M (Present Invention) | 0.80 | 0.79 | 0.83 | 0.99 | 0.99 | 0.96 | 0.98 | 0.98 | 0.95 |
| N (Comparison) | 0.74 | 0.70 | 0.64 | 0.98 | 0.99 | 0.93 | 0.97 | 0.97 | 0.89 |
| O (Present Invention) | 0.83 | 0.83 | 0.83 | 1.00 | 0.99 | 0.97 | 0.98 | 0.98 | 0.95 |
| P (Present Invention) | 0.81 | 0.80 | 0.80 | 0.99 | 0.99 | 0.96 | 0.98 | 0.97 | 0.97 |
| Q (Comparison) | 0.75 | 0.69 | 0.72 | 0.98 | 0.99 | 0.95 | 0.97 | 0.98 | 0.90 |
| R (Present Invention) | 0.82 | 0.80 | 0.81 | 0.99 | 1.00 | 0.98 | 0.99 | 0.98 | 0.96 |
| S (Present Invention) | 0.83 | 0.81 | 0.82 | 0.99 | 0.99 | 0.97 | 0.98 | 0.97 | 0.95 |
| T (Comparison) | 0.74 | 0.70 | 0.66 | 0.99 | 0.98 | 0.92 | 0.97 | 0.97 | 0.89 |
| U (Present Invention) | 0.83 | 0.82 | 0.82 | 0.98 | 0.99 | 0.97 | 0.98 | 0.98 | 0.96 |
| V (Comparison) | 0.74 | 0.71 | 0.67 | 0.98 | 0.99 | 0.93 | 0.97 | 0.98 | 0.88 |
| W (Present Invention) | 0.82 | 0.84 | 0.83 | 1.00 | 1.00 | 0.97 | 0.98 | 0.98 | 0.97 |
| X (Present Invention) | 0.83 | 0.83 | 0.84 | 0.99 | 0.99 | 0.96 | 0.98 | 0.98 | 0.96 |
| Y (Comparison) | 0.75 | 0.70 | 0.73 | 0.99 | 0.98 | 0.92 | 0.97 | 0.97 | 0.89 |
| Z (Present Invention) | 0.83 | 0.85 | 0.88 | 1.00 | 0.99 | 0.97 | 0.99 | 0.98 | 0.95 |

Note:
$D_B$, $D_G$ and $D_R$ represent the densities of yellow, magenta and cyan, respectively.

From Table III, it is seen that in the comparative samples, the light fastness was poor, and the image densities, especially the cyan dye image density was markedly reduced both in the light fading test and the dark heat fading test.

On the other hand, the samples of the present invention scarcely suffered deterioration both in light and dark heat, and maintained almost the same degree of image density in cyan, magent and yellow colors. Thus, in the samples of the present invention, color balance was well maintained and color reproducibility was remarkably improved.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon a silver halide emulsion layer containing at least one each of cyan color image forming couplers represented by the following general formulae (I) and (II):

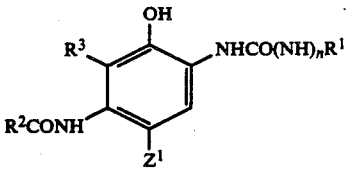

(I)

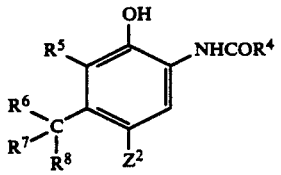

(II)

wherein:

$R^1$, $R^2$ and $R^4$, which may be the same or different, each represents an aliphatic hydrocarbon group, a substituted aliphatic hydrocarbon group, an aryl group, a substituted aryl group, a heterocyclic group or a substituted heterocyclic group;

$R^3$ and $R^5$, which may be the same or different, each represents a hydrogen atom, a halogen atom, an alkyl group or an acylamino group, or $R^3$ represents a non-metallic atomic group necessary for forming a nitrogen-containing 5- or 6-membered ring together with $R^2$;

$R^6$ represents a normal alkyl group having 1 to 14 carbon atoms;

$R^7$ and $R^8$ each represent a hydrogen atom;

$Z^1$ and $Z^2$, which may be the same or different, each represents a hydrogen atom or a group capable of being eliminated by a coupling reaction with an oxidation product of a developing agent;

n represents 0 or 1; and further wherein said emulsion layer contains at least one compound represented by general formula (III) or (IV):

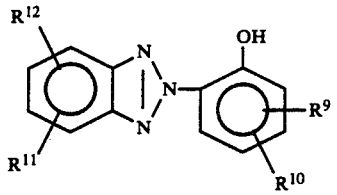

(III)

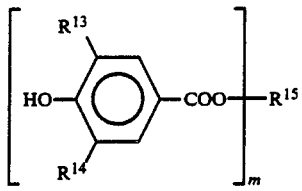

(IV)

wherein:

$R^9$, $R^{10}$, $R^{11}$ and $R^{12}$, which may be the same or different, each represents a hydrogen atom, a halogen atom, a nitro group, a cyano group, an alkyl group, a substituted alkyl group, an alkoxy group, an aryl group, an aryloxy group, an acylamino group or an alkoxycarbonyl group;

$R^{13}$ and $R^{14}$, which may be the same or different, each represents a hydrogen atom, an alkyl group or a substituted alkyl group, provided that $R^{13}$ and $R^{14}$ do not both represent a hydrogen atom; and $R^{15}$ represents an m-valent organic group, with m being an integer of 1 to 4, and wherein said compound represented by general formula (III) is additionally present in at least one layer adjacent to said emulsion layer.

2. A color photographic light-sensitive material as claimed in claim 1, wherein $R^1$ represents an aryl group, a substituted aryl group, a heterocyclic group or a substituted heterocyclic group;

$R^2$ represents an alkyl group, a substituted alkyl group, an aryl group or a substituted aryl group;

$R^3$ represents a hydrogen atom;

$R^4$ represents an alkyl group, a substituted alkyl group, an aryl group or a substituted aryl group;

$R^5$ represents a hydrogen atom or a halogen atom; and $Z^1$ and $Z^2$ each represents a hydrogen atom, a halogen atom, an alkoxy group, a substituted alkoxy group, an aryloxy group or a sulfonamido group.

3. A color photographic light-sensitive material as claimed in claim 2, wherein $R^1$ represents an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, a hydroxycarbonyl group, or a cyano group;

$R^2$ and $R^4$ each represents an alkyl group substituted with an aryloxy group which may further be substituted;

$R^6$ represents a normal alkyl group containing 1 to 3 carbon atoms; and $R^5$ represents a chlorine atom or a fluorine atom.

4. A color photographic light-sensitive material as claimed in claim 1, wherein said cyan color image forming couplers represented by general formulae (I) and (III) are present in the silver halide emulsion layer in a total amount of from about 0.1 to 1.0 mol per mol of silver halide.

5. A color photographic light-sensitive material as claimed in claim 1, wherein said coupler represented by general formula (II) is present in an amount of from about 0.2 to 5 mols per mol of said coupler represented by general formula (I).

6. A color photographic light-sensitive material as claimed in claim 1, wherein said compound represented by general formula (III) is present in an amount of from about $1\times10^{-4}$ mol/m$^2$ to $2\times10^{-3}$ mol/m$^2$.

7. A color photographic light-sensitive material as claimed in claim 6, wherein said compound according to general formula (III) is present in an amount of from about $5\times10^{-4}$ mol/m$^2$ to $1.5\times10^{-3}$ mol/m$^2$.

8. A color photographic light-sensitive material as claimed in claim 1, wherein said compound represented by general formula (IV) is present in the layer containing at least one each of cyan color image forming couplers represented by general formulae (I) and (II) in an amount of from about 5 to 200 mol % based on the amount of the cyan color image forming couplers.

9. A color photographic light-sensitive material as claimed in claim 1, wherein said photographic light-sensitive material is a color paper comprising a blue-sensitive layer containing a yellow color image forming coupler, a green-sensitive layer containing a magenta color image forming coupler, interlayer containing at least one compound represented by general formula (III), a red-sensitive silver halide emulsion layer containing at least one each of said cyan color image forming couplers represented of said cyan color image forming couplers represented by general formulae (I) and (II) and further containing at least one compound represented by the general formulae (III) or (IV), and an upper layer containing at least one compound represented by general formula (III), provided on said support in that order.

10. A color photographic light-sensitive material as claimed in claim 9, wherein said yellow color image forming coupler is represented by general formula (V):

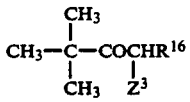

(V)

wherein:

$R^{16}$ represents an optionally substituted N-phenylcarbamoyl group; and $Z^3$ represents a hydrogen atom or a group capable of being eliminated by a coupling reaction with an oxidation product of a developing agent (i.e., a coupling-off group), with $Z^3$ optionally forming a dimer or larger polymer.

11. A color photographic light-sensitive material as claimed in claim 9, wherein said magenta color image forming coupler is 1H-pyrazolo[1,5-b][1,2,4]triazole.

12. A color photographic light-sensitive material as claimed in claim 9, wherein said magenta color image-forming coupler is a pyrazoloazole compound.

* * * * *